US007726226B2

(12) United States Patent
Pan et al.

(10) Patent No.: US 7,726,226 B2
(45) Date of Patent: Jun. 1, 2010

(54) TRIMMING APPARATUS OPERABLE IN AUTO MODE OR MANUAL MODE

(75) Inventors: Yung-Tai Pan, Taipei (TW); Shin-Fu Lin, Taipei (TW)

(73) Assignee: Primax Electronics Ltd., Taipei (TW)

( * ) Notice: Subject to any disclaimer, the term of this patent is extended or adjusted under 35 U.S.C. 154(b) by 247 days.

(21) Appl. No.: 12/131,359

(22) Filed: Jun. 2, 2008

(65) Prior Publication Data

US 2009/0173203 A1 Jul. 9, 2009

(30) Foreign Application Priority Data

Jan. 4, 2008 (TW) ..... 97100407 A

(51) Int. Cl.
*B26D 5/08* (2006.01)

(52) U.S. Cl. ..... 83/571; 83/455; 83/573; 83/614

(58) Field of Classification Search ..... 83/571, 83/572, 573, 614, 616, 455, 563, 564
See application file for complete search history.

(56) References Cited

U.S. PATENT DOCUMENTS 3,951,252 A * 4/1976 Selke et al. ..... 83/482
3,958,477 A * 5/1976 Carlson ..... 83/455
5,296,872 A * 3/1994 Caamano ..... 346/24
5,937,723 A * 8/1999 Kirikoshi et al. ..... 83/614

* cited by examiner

*Primary Examiner*—Stephen Choi
(74) *Attorney, Agent, or Firm*—Kirton & McConkie; Evan R. Witt

(57) ABSTRACT

The present invention relates to a trimming apparatus operable in an auto mode or a manual mode. The trimming apparatus include a cutter frame, a transmission belt, a motor, a clamping element, a switch and a mode-switching unit. By adjusting the mode-switching unit to control clamping element to clamp or release the transmission belt, the trimming apparatus 100 is operated in either the auto mode or the manual mode.

10 Claims, 2 Drawing Sheets

TRIMMING APPARATUS OPERABLE IN AUTO MODE OR MANUAL MODE

FIELD OF THE INVENTION

The present invention relates to a trimming apparatus, and more particularly to a trimming apparatus operable in an auto mode or a manual mode.

BACKGROUND OF THE INVENTION

With increasing industrial development, electronic office technologies have experienced great growth and are now rapidly gaining in popularity. In other words, a diversity of office machines such as personal computers, printers, copy machines or multifunction peripherals are utilized to achieve various purposes. As a consequence, the working efficiency is enhanced. Recently, automatic shredders, electronic punches, automatic trimmers are prevailing.

Take a conventional automatic trimming apparatus for example. After ten or more documents are placed on the platform of the automatic trimming apparatus and the plug is connected to the utility power, the automatic trimming apparatus can be powered on to uniformly trim the documents. In some situations where only one or two documents are intended to trim, the conventional manual trimming apparatus is more convenient than the automatic trimming apparatus. Since the conventional automatic trimming apparatus can only be operated in the auto mode rather than the manual mode, the conventional automatic trimming apparatus is not user-friendly.

Therefore, there is a need of providing a trimming apparatus operable in an auto mode or a manual mode, in which the operating mode is selected according to the user's requirement.

SUMMARY OF THE INVENTION

The present invention relates to a trimming apparatus, and more particularly to a trimming apparatus operable in an auto mode or a manual mode.

In accordance with an aspect of the present invention, there is provided a trimming apparatus operable in an auto mode or a manual mode for trimming a document in either the auto mode or the manual mode. The trimming apparatus include a platform, a cutter frame, a transmission belt, a motor, a clamping element, a switch and a mode-switching unit. The document to be trimmed in placed on the platform. The cutter frame is mounted on the platform and includes a cutting tool for trimming the document. The transmission belt is disposed beside the cutter frame for moving the cutter frame. The motor is disposed on one edge of the platform for driving the transmission belt. The clamping element is used for selectively clamping the transmission belt or releasing the transmission belt. The switch is disposed on the cutter frame for issuing either a conducting signal to enable the motor or an interrupt signal to disenable the motor. The mode-switching unit is arranged on the cutter frame for switching the operating mode of the trimming apparatus, and is selectively combined with or detached from the cutter frame according to the operating mode. When the mode-switching unit is switched to a first position, the mode-switching unit is detached from the cutter frame to trigger the switch to issue the conducting signal and to have the clamping element clamp the transmission belt such that the trimming apparatus is operated in the auto mode. When the mode-switching unit is switched to a second position, the mode-switching unit is disconnected from the switch to issue the interrupt signal and to have the clamping element release the transmission belt such that the trimming apparatus is operated in the manual mode.

In an embodiment, the mode-switching unit includes a knob member and a rotating disc. When the mode-switching unit is switched to the first position, the knob member is detached from the cutter frame, the rotating disc triggers the switch to issue the conducting signal and the clamping element clamps the transmission belt such that the trimming apparatus is operated in the auto mode. When the mode-switching unit is switched to the second position, the rotating disc is disconnected from the switch to issue the interrupt signal, and the clamping element release the transmission belt such that the trimming apparatus is operated in the manual mode.

In an embodiment, the trimming apparatus further includes a case with a first hooking part, which is disposed on an inner surface of the case.

In an embodiment, the cutter frame further includes a second hooking part, which is disposed on a peripheral of the rotating disc.

In an embodiment, the rotating disc has a perforation in a center thereof, and the trimming apparatus further includes a first spring received in the perforation.

In an embodiment, the knob member includes a knob body, a central leg and an edge leg. The central leg is coupled to the rotating disc and sustained against the first spring. The edge leg is coupled with the first hooking part to fix the knob member on the case when the knob member is rotated to the first direction and the central leg is detached from the rotating disc. Alternatively, the edge leg is coupled with the cutter frame to fix the knob member on the cutter frame when the knob member is rotated to the second direction and the central leg is coupled with the rotating disc.

In an embodiment, the rotating disc further includes a sustaining part, which is integrated into the rotating disc.

In an embodiment, the clamping element further includes a first clamping part and a second clamping part. The first clamping part is disposed on one side of the transmission belt. When the trimming apparatus is operated in the auto mode, the first clamping part is sustained by the sustaining part to be contacted with the transmission belt. The second clamping part is disposed on the other side of the transmission belt and coupled to the cutter frame.

In an embodiment, the second clamping part is integrated into the cutter frame.

In an embodiment, the trimming apparatus further includes a second spring, which is arranged between the first clamping part and the second clamping part.

The above objects and advantages of the present invention will become more readily apparent to those ordinarily skilled in the art after reviewing the following detailed description and accompanying drawings, in which:

DETAILED DESCRIPTION OF THE PREFERRED EMBODIMENT

Figure 1:
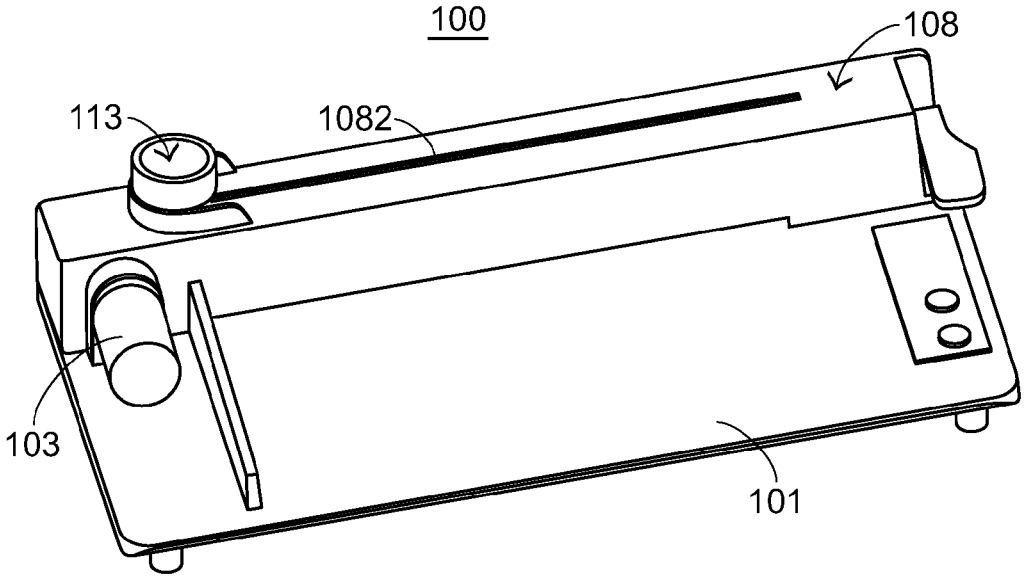
FIG. 1 is a schematic perspective view of an automatic trimming apparatus according to a preferred embodiment of the present invention.

Referring to FIG. 1, a schematic perspective view of an automatic trimming apparatus according to a preferred embodiment of the present invention is illustrated. The trimming apparatus 100 of the present invention includes a platform 101, a case 108, a motor 103 and a mode-switching unit 113. The platform 101 has an article supporting surface for placing thereon the documents to be trimmed (not shown). The case 108 has an elongate slot 1082 in a surface thereof. A transmission belt and a cutter frame are disposed inside the case 108. The transmission belt and the cutter frame are not shown in FIG. 1 because they are shielded by the case 108. The cutter frame includes a cutting tool (not shown in FIG. 1). The cutter frame is coupled to the mode-switching unit 113. The transmission belt is driven by the motor 103 to move the cutter frame along the elongate slot 1082 while trimming the documents on the platform 101 by the cutting tool of the cutter frame.

Figure 2:
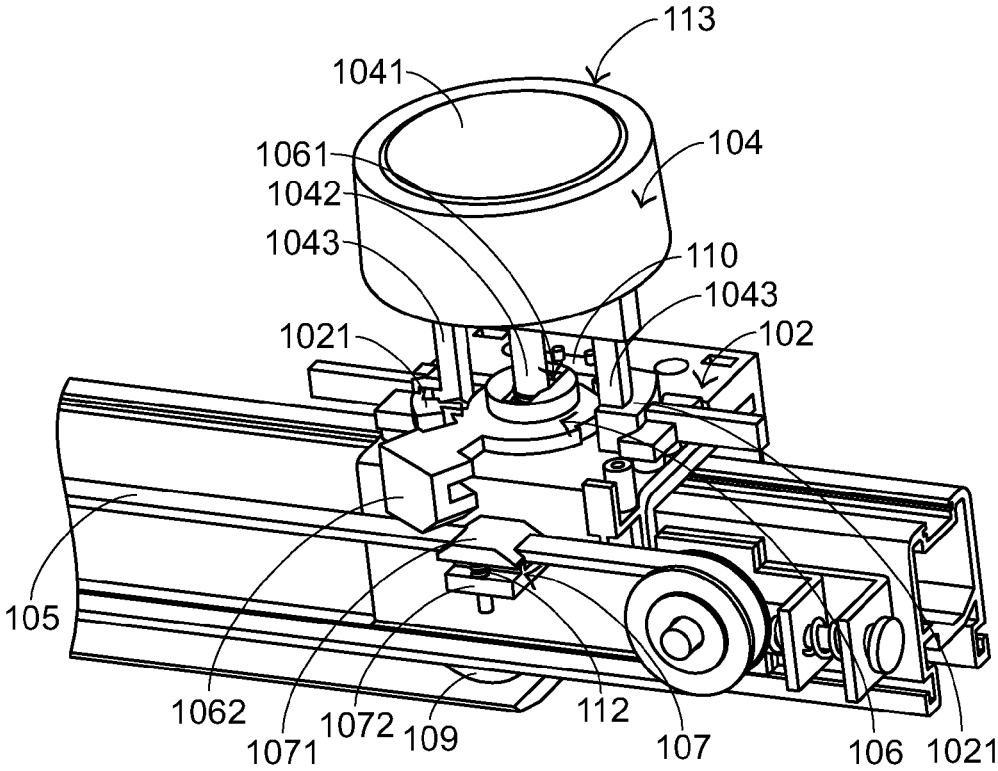
FIG. 2 is a schematic perspective view illustrating the components inside the case of the trimming apparatus in the manual mode.

Hereinafter, the components inside the case 108 of the trimming apparatus 100 will be illustrated with reference to FIG. 2. As shown in FIG. 2, the trimming apparatus 100 is operated in a manual mode. Within the case 108 shown in FIG. 1, the trimming apparatus 100 includes a cutter frame 102, a transmission belt 105, a clamping element 107, a switch 110 and the mode-switching unit 113. The mode-switching unit 113 includes a knob member 104 and a rotating disc 106. The rotating disc 106 is mounted on the cutter frame 102 and includes a perforation 1061 in the center and a sustaining part 1062. The sustaining part 1062 is integrated into the rotating disc 106. The knob member 104 includes a knob body 1041, a central leg 1042 and an edge leg 1043. The central leg 1042 of the knob member 104 pierces through the perforation 1061 of the rotating disc 106 and is then mounted on the cutter frame 102. For operating the trimming apparatus 100 in the manual mode, the knob member 104 is rotated to a second position such that the edge leg 1043 is engaged with a second hooking part 1021 of the cutter frame 102. After the edge leg 1043 is engaged with the second hooking part 1021, the knob member 104 is fixed on the cutter frame 102.

The transmission belt 105 is driven by the motor 105 to move. After the transmission belt 105 is nipped by the clamping element 107, the cutter frame 102 is synchronously moved with the transmission belt 105. The cutting tool 10 mounted on the bottom of the cutter frame 102 would perform a trimming operation on the documents which are supported on the platform 101 during movement of the cutter frame 102. The clamping element 107 includes a first clamping part 1071 and a second clamping part 1072. The first clamping part 1071 is disposed on one side of the transmission belt 105 and the second clamping part 1072 is disposed on the other side of the transmission belt 105. A second spring 112 is arranged between the first clamping part 1071 and the second clamping part 1072 for controlling the first clamping part 1071 to be close to or far away from the second clamping part 1072. In this embodiment, the second clamping part 1072 is integrated into the cutter frame 102. By controlling the first clamping part 1071 to be close to or far away from the second clamping part 1072, the transmission belt 105 is clamped or not clamped by the clamping element 107 such that the trimming apparatus 100 is operated in either an auto mode or a manual mode. In this embodiment, the transmission belt 105 is not clamped by the clamping element 107 in the manual mode but the transmission belt 105 is clamped by the clamping element 107 in the auto mode.

In response to a downward external force exerted on the first clamping part 1071, the first clamping part 1071 is moved to be close to the second clamping part 1072 such that the transmission belt 105 is clamped by the clamping element 107. This downward external force is offered by the sustaining part 1062 of the rotating disc 106. The principle of offering the downward external force to have the clamping element 107 clamp the transmission belt 105 will be illustrated in details as follows with reference to the section about the auto mode of the trimming apparatus 100.

Moreover, the switch 110 is disposed on the cutter frame 102. By switching the switch 110 to the auto mode, a conducting signal is issued to the motor 103. In response to the conducting signal, the motor 103 is enabled and lies in a wait status. On the contrary, an interrupt signal is issued to the motor 103 when the switch 110 is switched to the manual mode. In response to the interrupt signal, the motor 103 is disenabled.

Please refer to FIG. 1 and FIG. 2 again. When the trimming apparatus 100 is operated in the manual mode, the knob body 1041 of the knob member 104 of the mode-switching unit 113 is rotated such that the central leg 1042 of the knob member 104 pierces through the perforation 1061 of the rotating disc 106 and the edge leg 1043 is engaged with a second hooking part 1021 of the cutter frame 102. Under this circumstance, the sustaining part 1062 of the rotating disc 106 is separated from the first clamping part 1071 of the clamping element 107 and thus the transmission belt 105 is released from the clamping element 107, as can be seen in FIG. 2. At this moment, the terminal of the rotating disc 106 opposite to the sustaining part 1062 is no longer contacted with the switch 110, and thus an interrupt signal is issued from the switch 110 to disenable the motor 103. Since the transmission belt 105 is released from the clamping element 107 and the motor 103 is disenabled when the trimming apparatus 100 is operated in the manual mode, the cutter frame 102 is detached from the transmission belt 105 and is movable by an external force. The user may grip the knob body 1041 of the knob member 104, and then push the knob body 1041 to have the cutter frame 102 move along the elongate slot 1082 so as to trim the documents on the platform 101 by the cutting tool 109 on the bottom of the cutter frame 102.

Figure 3:
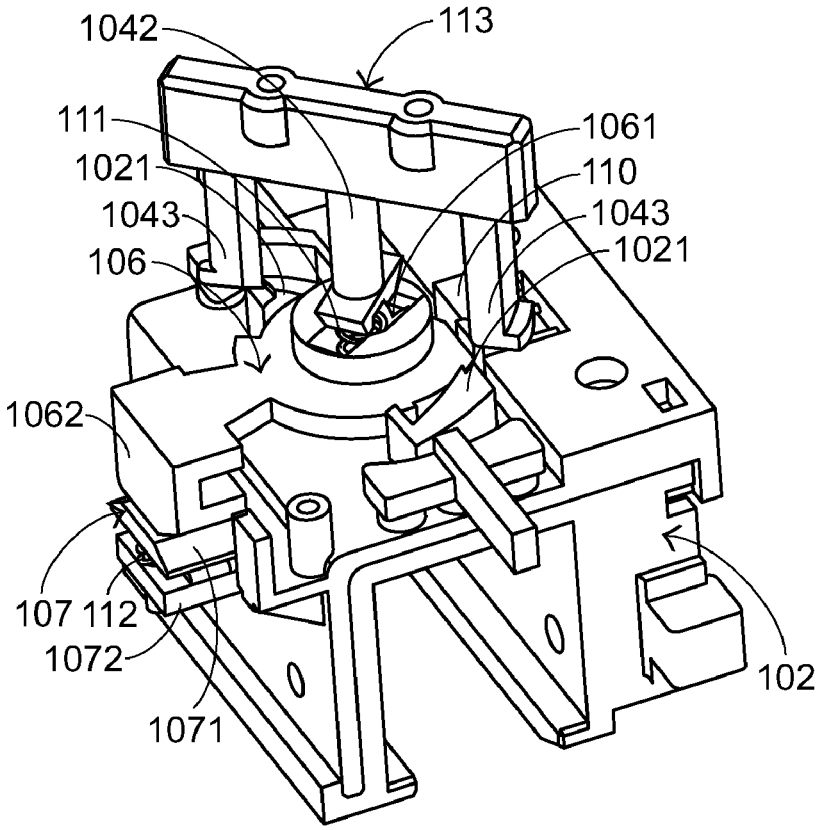
FIG. 3 is a schematic perspective view illustrating the components inside the case of the trimming apparatus in the auto mode.
Figure 4:
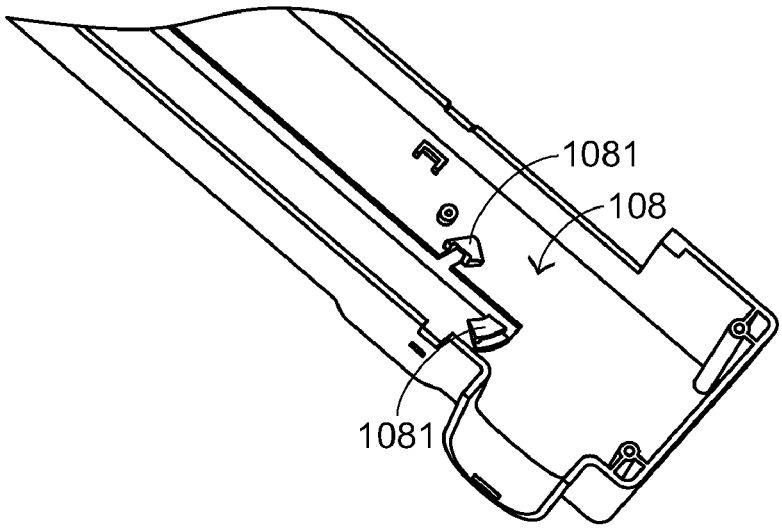
FIG. 4 is a schematic perspective view illustrating the inner surface of the case of the trimming apparatus.

The user may rotate the knob body 1041 of the knob member 104 in order to switch the operating mode of the trimming apparatus 100 from the manual mode to the auto mode. FIG. 3 is a schematic perspective view illustrating the components inside the case 108 of the trimming apparatus 100, in which the trimming apparatus 100 is operated in the auto mode. Please refer to FIG. 1 and FIG. 3. For a purpose of operating the trimming apparatus 100 in the auto mode, the knob body 1041 of the knob member 104 of the mode-switching unit 113 needs to be rotated from the second position to the first position such that the edge leg 1043 is disengaged from the second hooking part 1021. Meanwhile, the central leg 1042 of the knob member 104 bounces out of the perforation 1061 of the rotating disc 106 due to a restoring force resulted from a first spring 111, which is received within the perforation 1061. Therefore, the knob member 104 is uplifted. The second hooking part 1021 has a slant sidewall. After the edge leg 1043 is disengaged from the second hooking part 1021, the edge leg 1043 is moved along the slant sidewall. Meanwhile, the knob member 104 is detached from the cutter frame 102 and the edge leg 1043 is engaged with a first hooking part 1081 on the casing 108 (as shown in FIG. 4). Due to the engagement of the edge leg 1043 and the first hooking part 1081, the knob member 104 is fixed on the case 108.

Please refer to FIG. 3 again. During the knob body 1041 of the knob member 104 is moved toward the first position and before the central leg 1042 is detached from the cutter frame 102, the rotating disc 106 is still coupled to the central leg 1042 and thus the rotating disc 106 is synchronously rotated with the knob member 104. Until the sustaining part 1062 of the rotating disc 106 is rotated to the location overlying the clamping element 107, the sustaining part 1062 is sustained against the first clamping part 1071 to apply a downward external force on the first clamping part 1071. In response to the downward external force, the first clamping part 1071 is moved toward the second clamping part 1072 and the second spring 112 between the first clamping part 1071 and the second clamping part 1072 is compressed. As a result, the transmission belt 105 is clamped by the clamping element 107 and the cutter frame 102 is synchronously moved with the transmission belt 105. Until the sustaining part 1062 of the rotating disc 106 is rotated to the location overlying the clamping element 107 (i.e. the first position), the terminal of the rotating disc 106 opposite to the sustaining part 1062 is contacted with the switch 110 to trigger the switch 110 to issue a conducting signal. In response to the conducting signal, the motor 103 (as shown in FIG. 1) is enabled and lies in a wait status.

When the components inside the case 108 of the trimming apparatus are in the wait status, the sustaining part 1062 is sustained against the first clamping part 1071 and the transmission belt 105 is clamped by the clamping element 107. Meanwhile, the central leg 1042 of the knob member 104 bounces out of the perforation 1061 of the rotating disc 106 due to a restoring force resulted from the first spring 111, and the edge leg 1043 is fixed on the case 108 (as shown in FIG. 4). Under this circumstance, after the trimming apparatus 100 is powered on, the motor 103 can drive the transmission belt 105 to move the cutter frame along the elongate slot 1082 while trimming the documents on the platform 101 by the cutting tool 109 of the cutter frame 102.

It is noted that, however, those skilled in the art will readily observe that numerous modifications and alterations may be made while retaining the teachings of the invention. For example, the switch may be dispensed with. For safety, it is preferred that the switch is turned off to interrupt supply electricity to the motor when the trimming apparatus is operated in the manual mode. Since the cutter frame is no longer contacted with the transmission belt when the trimming apparatus is operated in the manual mode, the risk of moving the cutter frame by the transmission belt is avoided.

From the above description, the mode-switching unit of the trimming apparatus according to the present invention has three functions includes (a) the function of controlling the clamping element to clamp or release the transmission belt, (b) the function of controlling on/off statuses of the switch, and (c) the function of using as a manual operating handle in the manual mode.

In the above embodiments, the mode-switching unit can switch the operating mode of the trimming apparatus by rotating the knob member. Nevertheless, the operating mode of the trimming apparatus can be switched between a manual mode and an auto mode by vertically pulling/pushing the mode-switching unit or horizontally shifting the mode-switching unit.

When the trimming apparatus is operated in the auto mode, the transmission belt is driven by the motor to move the cutter frame. Since the knob member is partially exposed outside of the case, the foreign matter is possibly entangled with the knob member. For preventing the risk of entangling with the foreign matter, the cutter frame is preferably immobile when the trimming apparatus is operated in the auto mode. Since the knob member is detached from the cutter frame but fixed on the case when the trimming apparatus is operated in the auto mode, the knob member is not synchronously moved with the cutter frame. Under this circumstance, no components outside the case are movable and the risk of entangling with the foreign matter is avoided. Therefore, the trimming apparatus of the present invention can be used with great safety.

Moreover, the trimming apparatus of the present invention can be switched to the auto mode or the manual mode according to the user's requirement. In comparison with the conventional trimming apparatus, the present invention is more flexible in views of applications. The trimming apparatus of the present invention has simplified structure. By switching the knob member between a first position and a second position, the operating mode of the trimming apparatus is adjustable. As a result, the trimming apparatus of the present invention is very user-friendly.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A trimming apparatus operable in an auto mode or a manual mode for trimming a document in either said auto mode or said manual mode, said trimming apparatus comprising:

a platform for placing said document thereon;

a cutter frame mounted on said platform and including a cutting tool for trimming said document;

a transmission belt disposed beside said cutter frame for moving said cutter frame;

a motor disposed on one edge of said platform for driving said transmission belt;

a clamping element for selectively clamping said transmission belt or releasing said transmission belt;

a switch disposed on said cutter frame for issuing either a conducting signal to enable said motor or an interrupt signal to disenable said motor; and a mode-switching unit arranged on said cutter frame for switching the operating mode of said trimming apparatus, and selectively combined with or detached from said cutter frame according to said operating mode, wherein when said mode-switching unit is switched to a first position, said mode-switching unit is detached from said cutter frame to trigger said switch to issue said conducting signal and to have said clamping element clamp said transmission belt such that said trimming apparatus is operated in said auto mode, and when said mode-switching unit is switched to a second position, said mode-switching unit is disconnected from said switch to issue said interrupt signal and to have said clamping element release said transmission belt such that said trimming apparatus is operated in said manual mode.

2. The trimming apparatus operable in an auto mode or a manual mode according to claim 1 wherein said mode-switching unit includes a knob member and a rotating disc, wherein when said mode-switching unit is switched to said first position, said knob member is detached from said cutter frame, said rotating disc triggers said switch to issue said conducting signal and said clamping element clamps said transmission belt such that said trimming apparatus is operated in said auto mode, and when said mode-switching unit is switched to said second position, said rotating disc is disconnected from said switch to issue said interrupt signal, and said clamping element release said transmission belt such that said trimming apparatus is operated in said manual mode.

3. The trimming apparatus operable in an auto mode or a manual mode according to claim 2 wherein said trimming apparatus further includes a case with a first hooking part, which is disposed on an inner surface of said case.

4. The trimming apparatus operable in an auto mode or a manual mode according to claim 3 wherein said cutter frame further includes a second hooking part, which is disposed on a peripheral of said rotating disc.

5. The trimming apparatus operable in an auto mode or a manual mode according to claim 4 wherein said rotating disc has a perforation in a center thereof, and said trimming apparatus further includes a first spring received in said perforation.

6. The trimming apparatus operable in an auto mode or a manual mode according to claim 5 wherein said knob member includes:

a knob body;

a central leg coupled to said rotating disc and sustained against said first spring; and an edge leg selectively coupled with said first hooking part to fix said knob member on said case when said knob member is rotated to said first direction and said central leg is detached from said rotating disc, or coupled with said cutter frame to fix said knob member on said cutter frame when said knob member is rotated to said second direction and said central leg is coupled with said rotating disc.

7. The trimming apparatus operable in an auto mode or a manual mode according to claim 6 wherein said rotating disc further includes a sustaining part, which is integrated into said rotating disc.

8. The trimming apparatus operable in an auto mode or a manual mode according to claim 7 wherein said clamping element further includes:

a first clamping part disposed on one side of said transmission belt, wherein said first clamping part is sustained by said sustaining part to be contacted with said transmission belt when said trimming apparatus is operated in said auto mode; and a second clamping part disposed on the other side of said transmission belt and coupled to said cutter frame.

9. The trimming apparatus operable in an auto mode or a manual mode according to claim 8 wherein said second clamping part is integrated into said cutter frame.

10. The trimming apparatus operable in an auto mode or a manual mode according to claim 9 wherein said trimming apparatus further includes a second spring, which is arranged between said first clamping part and said second clamping part.

* * * * *